US011371280B2

(12) United States Patent
Bernhagen et al.

(10) Patent No.: US 11,371,280 B2
(45) Date of Patent: Jun. 28, 2022

(54) MODULAR FRAME DESIGN

(71) Applicant: Pella Corporation, Pella, IA (US)

(72) Inventors: Todd A. Bernhagen, Pella, IA (US); Evan R. Vande Haar, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 16/397,634

(22) Filed: Apr. 29, 2019

(65) Prior Publication Data

US 2020/0291717 A1 Sep. 17, 2020

Related U.S. Application Data

(60) Provisional application No. 62/663,707, filed on Apr. 27, 2018.

(51) Int. Cl.

| | |
|---|---|
| ***E06B 3/08*** | (2006.01) |
| ***E06B 1/38*** | (2006.01) |
| ***E06B 3/96*** | (2006.01) |
| *E06B 3/22* | (2006.01) |
| *E06B 1/60* | (2006.01) |

(52) U.S. Cl.

CPC ..... *E06B 3/96* (2013.01); *E06B 3/08* (2013.01); *E06B 1/38* (2013.01); *E06B 1/6007* (2013.01); *E06B 3/22* (2013.01)

(58) Field of Classification Search

CPC ... E06B 3/96; E06B 3/08; E06B 3/306; E06B 3/22; E06B 1/6007; E06B 1/38

See application file for complete search history.

(56) References Cited

U.S. PATENT DOCUMENTS

| | | | | |
|---|---|---|---|---|
| 701,088 A | | 5/1902 | Ray | |
| 2,962,133 A | * | 11/1960 | Kivett | E04B 1/617 52/580 |
| 3,189,140 A | * | 6/1965 | Luss | E04B 2/76 52/204.597 |

(Continued)

FOREIGN PATENT DOCUMENTS

| | | |
|---|---|---|
| CA | 1132849 A | 10/1982 |
| CA | 1165348 A | 4/1984 |

(Continued)

OTHER PUBLICATIONS

Young's Modulus of Steel (https://amesweb.info/Materials/Youngs-Modulus-of-Steel.aspx which cites Metals Handbook. Properties and Selection: Irons, Steels, and High—Performance Alloys. ASM International, 1990) (Year: 1990).

(Continued)

*Primary Examiner* — Phi D A

(74) *Attorney, Agent, or Firm* — Faegre Drinker Biddle & Reath LLP

(57) ABSTRACT

A modular window assembly including a base frame, an interior frame cover, and an exterior frame cover. The base frame has a first complementary fastener located on an exterior face and a second complementary fastener located on an interior face. Each of the interior and exterior frame covers have a complementary fastener configured to releasably mate with the first and second complementary fasteners of the interior face and exterior face, respectively.

8 Claims, 11 Drawing Sheets

(56) References Cited

U.S. PATENT DOCUMENTS 3,290,847 A * 12/1966 Fenwick ..... E04B 2/7854 52/489.1
3,471,598 A * 10/1969 Battista ..... C08L 89/06 264/28
3,527,011 A * 9/1970 Bloom ..... E04B 2/962 52/204.593
3,685,227 A * 8/1972 Grisard ..... E04B 2/82 52/242
3,734,552 A 5/1973 Haxton
3,798,690 A 3/1974 Moore
3,810,337 A 5/1974 Pollard
3,816,011 A * 6/1974 Biebuyck ..... F16B 7/187 403/187
4,068,423 A 1/1978 Marsh
4,070,838 A * 1/1978 Kuhn ..... E04B 2/7854 49/DIG. 1
4,099,808 A 7/1978 Oakley et al.
4,115,972 A * 9/1978 Varlonga ..... E06B 3/26307 52/204.593
4,205,497 A * 6/1980 Schirm ..... C07F 7/123 52/93.2
4,282,687 A 8/1981 Teleskivi
4,311,183 A 1/1982 Herbst et al.
4,422,280 A 12/1983 Mertin et al.
4,432,166 A 2/1984 Weimar
4,553,286 A 11/1985 Schwarz, II
4,608,793 A * 9/1986 Yost ..... E06B 7/14 52/204.597
4,643,005 A 2/1987 Logas
4,738,069 A 4/1988 Williams
4,752,513 A 6/1988 Rau et al.
4,771,988 A 9/1988 Scroggins, Sr.
4,831,804 A 5/1989 Sayer
4,833,803 A * 5/1989 Schwartz ..... A47G 1/10 40/783
4,924,631 A * 5/1990 Davies ..... B29C 70/521 49/504
4,995,213 A 2/1991 Bezubic
5,005,333 A * 4/1991 Ott ..... E04C 2/384 52/476
5,039,571 A 8/1991 Vogelesang et al.
5,347,686 A 9/1994 Tyler et al.
5,360,246 A 11/1994 Leiter et al.
5,402,608 A 4/1995 Chu
5,487,937 A * 1/1996 Newby ..... E06B 3/66314 428/317.1
5,560,164 A 10/1996 Ahrens
5,570,548 A * 11/1996 Hopper ..... E06B 3/22 52/204.5
5,619,823 A 4/1997 Ruff et al.
5,634,306 A * 6/1997 Riegelman ..... E06B 3/205 52/309.16
5,644,881 A 7/1997 Neilly
5,647,172 A 7/1997 Rokicki
5,690,363 A 11/1997 Rybinski
5,702,816 A 12/1997 Kaiser
5,704,178 A 1/1998 Ciao
5,822,926 A 10/1998 Koike et al.
5,851,609 A * 12/1998 Baratuci ..... E06B 3/66328 428/34
5,876,553 A 3/1999 Kaiser
5,908,689 A 6/1999 Dana et al.
5,910,458 A 6/1999 Beer et al.
5,927,647 A 7/1999 Masters et al.
5,931,520 A 8/1999 Seksaria et al.
5,950,380 A 9/1999 Pearson
5,965,262 A 10/1999 Whisler et al.
5,989,376 A 11/1999 Kusy et al.
6,003,277 A * 12/1999 Graham ..... B29C 44/22 49/504
6,024,908 A 2/2000 Koncelik
6,054,699 A 4/2000 Kim et al.
6,055,783 A * 5/2000 Guhl ..... C03C 27/06 156/109
6,065,323 A 5/2000 Arduino et al.
6,065,540 A 5/2000 Thomeer et al.
6,151,947 A 11/2000 Arduino et al.
6,185,882 B1 2/2001 Pearson
6,227,609 B1 5/2001 Meilis
6,260,912 B1 7/2001 Mondragon Sarmiento et al.
6,286,288 B1 9/2001 France
6,315,351 B1 11/2001 Mondragon Sarmiento et al.
6,493,914 B2 12/2002 Kaiser et al.
6,800,164 B2 10/2004 Brandstrom
6,872,273 B2 3/2005 Davies et al.
6,966,945 B1 11/2005 Mazany et al.
6,986,859 B2 1/2006 Mazany et al.
7,010,888 B2 3/2006 Tumlin et al.
7,082,727 B2 8/2006 Schmidt
7,100,335 B2 9/2006 Plummer et al.
7,111,433 B2 9/2006 Kerscher
7,159,370 B2 1/2007 Oliphant et al.
7,179,522 B2 2/2007 Hiel et al.
7,255,333 B2 8/2007 Casper et al.
7,297,740 B2 11/2007 Dyksterhouse
7,316,446 B2 1/2008 Wikstrom
7,414,090 B2 8/2008 Wang et al.
7,491,356 B2 2/2009 Heikkila
7,520,099 B2 4/2009 Pringle et al.
7,521,385 B2 4/2009 Ahluwalia
7,540,250 B2 6/2009 Sjostedt et al.
7,563,733 B2 7/2009 Ahluwalia et al.
7,588,653 B2 9/2009 Crandell et al.
7,594,361 B2 9/2009 Tragant Ruano
7,732,358 B2 6/2010 Mazany et al.
7,739,851 B2 * 6/2010 Davis ..... E06B 3/56 52/656.9
7,743,584 B2 * 6/2010 Reichert ..... E06B 3/66323 52/745.15
7,815,247 B2 10/2010 Obayashi
7,866,569 B2 1/2011 Cadwell
7,951,449 B2 5/2011 Ma et al.
7,981,819 B2 7/2011 Ahluwalia
8,002,249 B2 8/2011 Casper et al.
8,011,165 B2 9/2011 Blahut
8,017,531 B2 9/2011 Ahluwalia et al.
8,020,351 B2 9/2011 Stephens
8,020,352 B2 9/2011 Aheam
8,030,229 B2 10/2011 Ahluwalia et al.
8,037,803 B2 10/2011 Friedman et al.
8,070,348 B2 12/2011 Khouri
8,109,706 B2 2/2012 Richards
8,131,125 B2 3/2012 de Montmorillon et al.
8,141,307 B2 3/2012 Hillman et al.
8,146,321 B2 4/2012 Plagemann et al.
8,265,442 B2 9/2012 Overton
8,349,109 B2 1/2013 Al-Emrani et al.
8,359,814 B2 1/2013 Williams
8,398,149 B2 3/2013 Weiter et al.
8,402,705 B2 3/2013 Petersen
8,407,952 B2 4/2013 Engelmeyer
8,439,685 B2 5/2013 Shelley
8,484,916 B2 7/2013 Farag
8,491,046 B2 7/2013 Nagai et al.
8,561,365 B2 10/2013 Albrecht et al.
8,656,643 B2 * 2/2014 Thielmann ..... E05C 9/16 49/321
8,672,006 B2 3/2014 Moon
8,813,442 B1 8/2014 Edwards et al.
8,863,454 B2 10/2014 Davies et al.
8,869,454 B2 10/2014 Griffin, Jr. et al.
8,904,721 B2 12/2014 Pantelides et al.
8,919,070 B2 12/2014 Moses et al.
8,925,279 B2 1/2015 Pantelides et al.
8,945,694 B2 2/2015 Aneja et al.
9,005,768 B2 4/2015 Mizrahi et al.
9,114,761 B2 8/2015 Schweindl et al.
9,145,627 B2 9/2015 Wilson et al.
9,151,056 B2 10/2015 Konstantin
9,175,705 B1 11/2015 Clark, Jr. et al.
9,212,482 B2 12/2015 Frederick

(56) References Cited

U.S. PATENT DOCUMENTS

| | | | | |
|---|---|---|---|---|
| 9,244,220 | B2 | 1/2016 | Overton | |
| 9,267,542 | B2 | 2/2016 | Scheibe et al. | |
| 9,382,398 | B1 | 7/2016 | Hughes | |
| 9,394,432 | B1 | 7/2016 | Hughes | |
| 9,409,347 | B2 * | 8/2016 | Nelson | B29C 70/521 |
| 9,441,405 | B2 | 9/2016 | Chubb et al. | |
| 9,447,557 | B2 | 9/2016 | Schiffmann et al. | |
| 9,453,367 | B1 | 9/2016 | Plummer | |
| 9,512,656 | B2 | 12/2016 | Lee | |
| 9,528,266 | B2 | 12/2016 | Konstantin | |
| 9,624,712 | B2 | 4/2017 | Bottin | |
| 9,631,416 | B2 | 4/2017 | Pulte et al. | |
| 9,649,835 | B2 | 5/2017 | Czerner | |
| 9,663,946 | B2 | 5/2017 | Frederick | |
| 9,728,302 | B1 | 8/2017 | McNutt | |
| 9,745,749 | B2 | 8/2017 | Ciuperca | |
| 2002/0000173 | A1 | 1/2002 | Cho | |
| 2002/0014302 | A1 | 2/2002 | Fanucci et al. | |
| 2002/0123288 | A1 | 9/2002 | Davies et al. | |
| 2003/0037397 | A1 | 2/2003 | Buchanan et al. | |
| 2003/0089066 | A1 * | 5/2003 | Nelson | E04B 2/763 52/424 |
| 2003/0126812 | A1 | 7/2003 | Folsom et al. | |
| 2004/0250484 | A1 | 12/2004 | Imai | |
| 2005/0051279 | A1 | 3/2005 | Hung | |
| 2005/0126079 | A1 | 6/2005 | Gerard | |
| 2006/0051546 | A1 | 3/2006 | Van Erp | |
| 2006/0196132 | A1 | 9/2006 | Ruano | |
| 2006/0290166 | A1 | 12/2006 | Gehringhoff et al. | |
| 2007/0094935 | A1 | 5/2007 | Molinari | |
| 2007/0119112 | A1 | 5/2007 | Goodman et al. | |
| 2007/0187986 | A1 | 8/2007 | Wikstrom | |
| 2007/0266661 | A1 | 11/2007 | Abbas-ul-Husaini | |
| 2008/0098676 | A1 | 5/2008 | Hutchens | |
| 2008/0178541 | A1 | 7/2008 | Kerscher et al. | |
| 2008/0246375 | A1 | 10/2008 | Berg | |
| 2008/0315628 | A1 | 12/2008 | Obayashi | |
| 2009/0013636 | A1 | 1/2009 | Wilson | |
| 2010/0199561 | A1 | 8/2010 | Weiter et al. | |
| 2010/0287855 | A1 | 11/2010 | Stephens | |
| 2011/0025076 | A1 | 2/2011 | Shelley | |
| 2011/0107722 | A1 | 5/2011 | Engelmeyer | |
| 2011/0123162 | A1 | 5/2011 | Molin et al. | |
| 2012/0212008 | A1 | 8/2012 | Kanovsky | |
| 2013/0004134 | A1 | 1/2013 | Molin et al. | |
| 2013/0042612 | A1 | 2/2013 | Shapiro et al. | |
| 2013/0042996 | A1 | 2/2013 | Hwang et al. | |
| 2013/0101845 | A9 | 4/2013 | Hiel et al. | |
| 2013/0133816 | A1 | 5/2013 | Ziegler et al. | |
| 2013/0195541 | A1 | 8/2013 | Pantelides et al. | |
| 2013/0334843 | A1 | 12/2013 | Schweindl et al. | |
| 2014/0045400 | A1 | 2/2014 | Vandewalle | |
| 2014/0127451 | A1 | 5/2014 | Pilpel et al. | |
| 2014/0260063 | A1 | 9/2014 | Edwards et al. | |
| 2015/0024175 | A1 | 1/2015 | Kelly et al. | |
| 2015/0096257 | A1 | 4/2015 | Sinnathamby et al. | |
| 2015/0118393 | A1 | 4/2015 | Ciuperca | |
| 2015/0121764 | A1 | 5/2015 | Lee | |
| 2015/0183930 | A1 | 7/2015 | Hsueh et al. | |
| 2015/0197929 | A1 | 7/2015 | Segall | |
| 2015/0219344 | A1 | 8/2015 | Glover et al. | |
| 2015/0354199 | A1 | 12/2015 | Segall | |
| 2015/0368955 | A1 * | 12/2015 | Zohar | B29C 48/12 52/204.5 |
| 2015/0376946 | A1 | 12/2015 | Kurzer et al. | |
| 2016/0090775 | A1 | 3/2016 | Albrecht | |
| 2016/0130389 | A1 | 5/2016 | Dugar et al. | |
| 2016/0160515 | A1 | 6/2016 | Wallance | |
| 2016/0251807 | A1 | 9/2016 | Hawkins et al. | |
| 2016/0257805 | A1 | 9/2016 | Markgraf et al. | |
| 2016/0339675 | A1 | 11/2016 | Mizrahi | |
| 2016/0367851 | A1 | 12/2016 | Astilean et al. | |
| 2017/0036428 | A1 | 2/2017 | Richards et al. | |
| 2017/0096831 | A1 | 4/2017 | Britt, Jr. | |
| 2017/0167185 | A1 * | 6/2017 | Boer | E06B 3/263 |
| 2017/0218649 | A1 | 8/2017 | Marks et al. | |
| 2017/0239916 | A1 | 8/2017 | Lewit et al. | |
| 2017/0241134 | A1 | 8/2017 | McCloud et al. | |
| 2017/0254017 | A1 | 9/2017 | Bertelo et al. | |
| 2019/0322008 | A1 | 10/2019 | Bernhagen et al. | |

FOREIGN PATENT DOCUMENTS

| | | | |
|---|---|---|---|
| CA | 1252641 | A | 4/1989 |
| CA | 1293284 | C | 12/1991 |
| CA | 2044331 | A1 | 12/1992 |
| CA | 2116768 | A1 | 3/1993 |
| CA | 2282358 | C | 8/1998 |
| CA | 2243225 | C | 1/1999 |
| CA | 2463099 | C | 5/2003 |
| CA | 2506006 | A1 | 5/2004 |
| CA | 2567760 | A1 | 1/2006 |
| CA | 2533057 | C | 7/2007 |
| CA | 2636669 | A1 | 7/2007 |
| CA | 2618610 | A1 | 7/2008 |
| CA | 2745429 | A1 | 6/2010 |
| CA | 2809699 | A1 | 9/2014 |
| CA | 2882712 | A1 | 8/2015 |
| CA | 2950781 | C | 5/2017 |
| CA | 2958837 | A1 | 8/2017 |
| CA | 2958839 | A1 | 8/2017 |
| WO | 2013083664 | A3 | 8/2013 |

OTHER PUBLICATIONS

Definition of aperture (Year: 2021).
Definition of ribbon (Year:2021).

* cited by examiner

MODULAR FRAME DESIGN

CROSS-REFERENCE TO RELATED APPLICATION

This application claims priority to Provisional Application No. 62/663,707, filed Apr. 27, 2018, which is herein incorporated by reference in its entirety.

FIELD

The present disclosure relates generally to designs for window frames and/or window assemblies. The disclosure also relates to methods of assembling window frames and window assemblies.

BACKGROUND

Basic window assemblies have traditionally included a base frame, a sash frame, a glazing material such as glass or another type of transparent or translucent material, and an optional accessory frame. The purpose of the base frame is to provide strength and rigidity to the window assembly. Thus, the base frame often comprises materials that have a high strength, stiffness, and/or modulus of elasticity such as wood, vinyl, aluminum, or steel. Materials such as these, though strong, can also be heavy and burdensome to install.

The base frame often has four, separate frame members that are adjoined at their ends to form the window frame. Often, the ends of these frame members are mitered or angled to facilitate even joining. However, joining mitered corners often requires the use of special tools, multiple screws or connectors, and more time and effort due to their increased design complexity.

Once the base frame is assembled, it is installed in an opening in a wall. The glazing material is inserted into the center of the base frame and the sash frame is sandwiched over it to hold the glazing material in place. If desired, an accessory frame can be installed over the sash frame to achieve a certain desired aesthetic or various performance characteristics. In current practices, the accessory frame is often permanently attached to the base frame or sash frame. Sometimes, the base frame may only be compatible with a certain accessory frame, making removal or replacement expensive and time-consuming once the window assembly has been installed.

SUMMARY

Various aspects of the present disclosure are directed toward apparatuses, systems, and methods that relate to window frames and/or window assemblies.

In some examples, a modular window assembly includes a base frame. The base frame has an interior face and an exterior face. The base frame includes a plurality of frame members. A first frame member of the plurality of frame members includes a first complementary fastener located on the exterior face of the first frame member. The first frame member also includes a second complementary fastener on the interior face of the first frame member. The window assembly also includes an interior frame cover. The interior frame cover has a complementary fastener configured to releasably mate with the first complementary fastener on the exterior face of the first frame member. The window assembly also includes an exterior frame cover. The exterior frame cover also includes a complementary fastener configured to releasably mate with the second complementary fastener on the interior face of the first frame member.

In some examples, a method for assembling a modular window includes securing a plurality of frame members together to form a base frame having an interior face and an exterior face. A first frame member of the plurality of frame members includes a first complementary fastener located on the exterior face of the first frame member and a second complementary fastener on the interior face of the first frame member. The method also includes releasably mating a complementary fastener of an interior frame cover with the first complementary fastener on the exterior face of the first frame member. The method also includes releasably mating a complementary fastener of an exterior frame cover with the second complimentary fastener on the interior face of the first frame member.

In some examples, a modular window frame includes a plurality of frame members. The plurality of frame members defines an interior region supporting a glass unit. The modular window frame includes a first frame member having a first end, a second end, an inner face, an outer face, a longitudinal axis, and a first reinforcement member oriented along the longitudinal axis. The modular window frame also includes a second frame member having a first end, a second end, an inner face, an outer face, a longitudinal axis, and a second reinforcement member oriented along the longitudinal axis. The first frame member and the second frame member are oriented perpendicular to one another. The first end of the first frame member is abutted to the inner face of the second frame member to form a non-chamfered corner. The modular window frame also includes a first fastener extending into the outer face of the second frame member, through the second reinforcement member, out from the inner face of the second frame member, and into the first end of the first frame member to secure the first frame member to the second frame member.

In some examples, a method for assembling a modular window frame includes orienting a first frame member having a first end, a second end, an inner face, an outer face, a longitudinal axis and a first frame member oriented along the longitudinal axis with a second frame member. The second frame member also has a first end, a second end, an inner face, an outer face, a longitudinal axis and a second reinforcement member oriented along the longitudinal axis. The first frame member and the second frame member are perpendicular to one another. The first end of the first frame member is abutted to the inner face of the second frame member to form a non-chamfered corner. The method also includes securing the first frame member to the second frame member by inserting a first fastener into the outer face of the second frame member, through the second reinforcement member, out from the inner face of the second frame member, and into the first end of the first frame member.

In some examples, a mulled window assembly includes a first window unit. The first window unit includes a first plurality of frame members. The first plurality of frame members includes an upper frame member, a lower frame member, a first side frame member, and a second side frame member. Each of the first plurality of frame members includes a reinforcement member. The window assembly also includes a second window unit. The second window unit includes a second plurality of frame members. The second plurality of frame members includes an upper frame member, a lower frame member, a first side frame member, and a second side frame member. Each of the second plurality of frame members includes a reinforcement member. The window assembly also includes a first mulling fastener extending through the second side frame member of the first window unit, the reinforcement member of the second side frame member, the first side frame member of the second window unit, and the reinforcement member of the first side frame member. The first window unit and the second window unit are adjacent to one another.

In some examples, a method for installing a mulled window assembly includes placing a first window unit. The first window unit includes a first plurality of frame members. The first plurality of frame members includes an upper frame member, a lower frame member, a first side frame member, and a second side frame member. Each of the first plurality of frame members includes a reinforcement member within an opening in a wall. The method also includes placing a second window unit. The second window unit includes a second plurality of frame members. The second plurality of frame members includes an upper frame member, a lower frame member, a first side frame member, and a second side frame member. Each of the second plurality of frame members includes a reinforcement member within the opening in the wall. The first window unit is adjacent the second window unit. The method also includes mulling the first window unit to the second window unit by inserting a first mulling fastener through the first side frame member of the first window unit and through the second side frame member of the second window unit.

While multiple inventive examples are specifically disclosed, various modifications and combinations of features from those examples will become apparent to those skilled in the art from the following detailed description. Accordingly, the disclosed examples are meant to be regarded as illustrative in nature and not restrictive.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Various embodiments relate generally to designs for modular window frames and/or window assemblies. Various aspects relate to methods for assembling modular window frames and window assemblies. In some examples, a window assembly includes a base frame including a plurality of frame members. One or more of the plurality of frame members may optionally include a reinforcement member located within the respective frame member. Additionally, one or more of the plurality of frame members may include one or more complementary fasteners configured to mate with a complementary fastener of an accessory member such as, for example, a frame cover.

Figure 1:
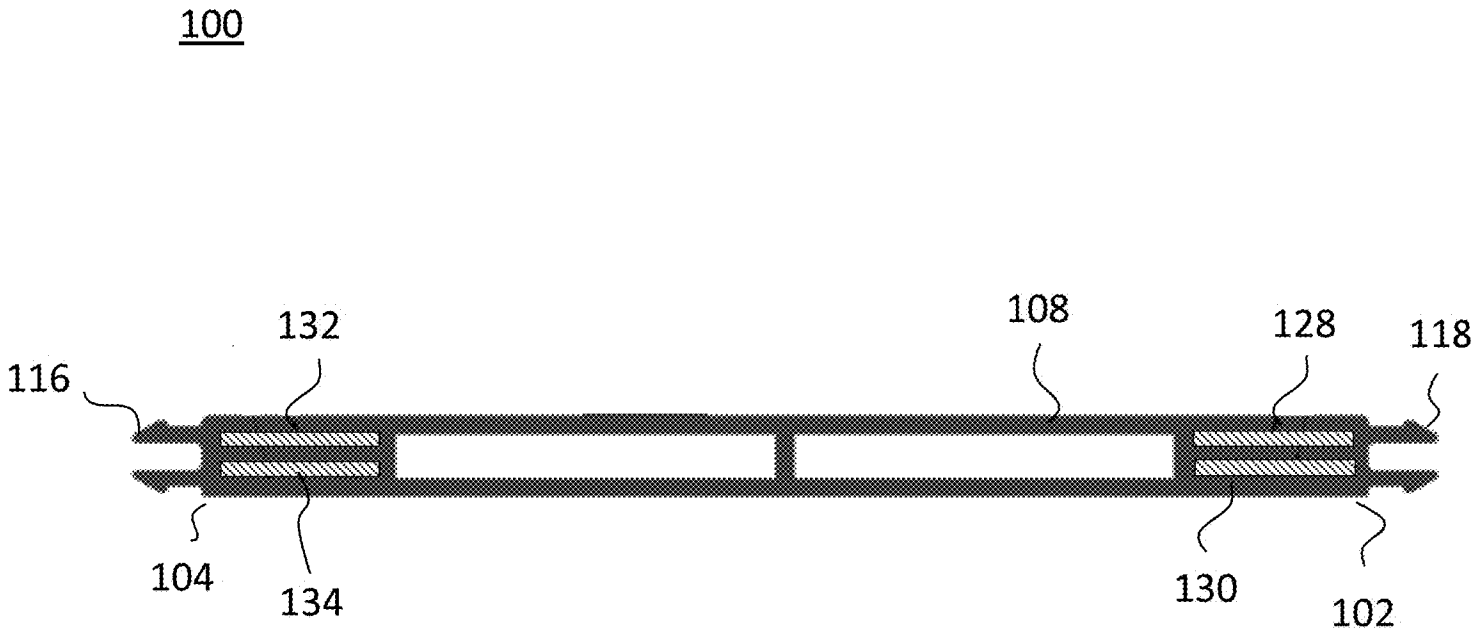
FIG. 1 is a cross-sectional view of a base frame, in accordance with an embodiment.

FIG. 1 is a cross-sectional view of a base frame, in accordance with an embodiment. In some embodiments, the base frame 100 has an interior face 102 and an exterior face 104. In various examples, the interior face 102 may be positioned toward an interior of a building and the exterior face 104 may be positioned toward an exterior of a building. In some embodiments, the base frame 100 includes a plurality of frame members 106 (FIG. 4A), which includes a first frame member 108, a second frame member 110, a third frame member 112 and a fourth frame member 114. In some embodiments, the first frame member 108 includes a first complementary fastener 116 located on the exterior face 104 of the first frame member 108 (FIG. 1). The first frame member 108 may also include a second complementary fastener 118 located on the interior face 102 of the first frame member 108.

In some embodiments, the first frame member 108 can comprise any of a variety of structural materials suitable for window frames, including fiberglass, vinyl, aluminum, steel, and various plastics. In some embodiments, the first frame member 108 may comprise pultruded fiberglass. Examples of various pultruded products suitable for use in window frames and/or window assemblies can be found in U.S. Publication No. 2002/0123288 filed on Dec. 11, 2001 by Pella Corporation.

Figure 2:
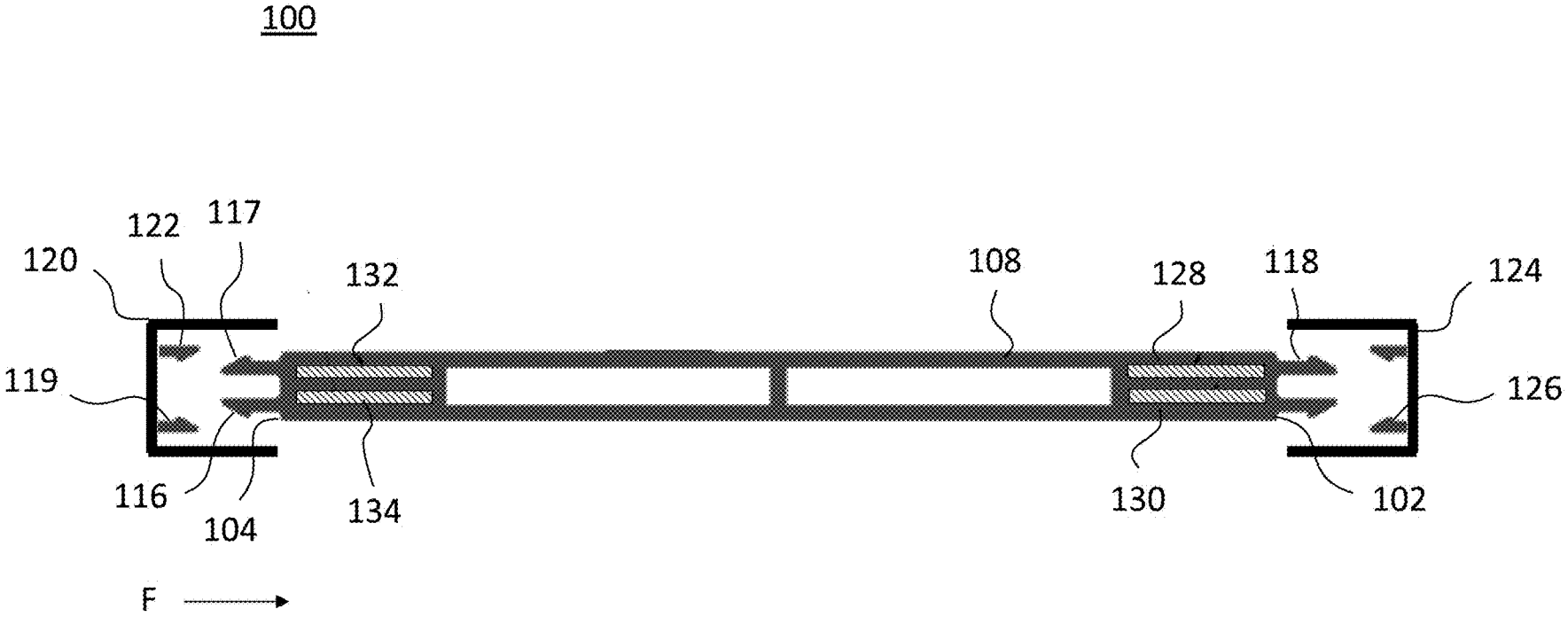
FIG. 2 is a cross-sectional view of an interior frame cover and an exterior frame cover mated with a based frame, in accordance with an embodiment.

In some embodiments, the base frame 100 includes an exterior frame cover 120, as shown in FIG. 2. The exterior frame cover 120 has a complementary fastener 122 configured to releasably mate with the first complementary fastener 116 of the first frame member 108. In some embodiments, the base frame 100 also includes an interior frame cover 124. The interior frame cover 124 has a complementary fastener 126 configured to releasably mate with the second complementary fastener 118 of the first frame member 108.

In some embodiments, the complementary fasteners of each of the interior face 102, the exterior face 104, the interior frame cover 124, and the exterior frame cover 120 (referred to herein simply as "complementary fasteners") include interlocking components configured to integrally attach to one another upon application of a joining force. As used herein, the term "joining force" is defined as any of a shear force, a rotational or annular force, or any other such force capable of overcoming a deflection force of the interlocking components. The term "deflection force" is generally defined as the amount of force required to cause enough flexion of the interlocking components for the complementary fasteners to snap into place.

In various embodiments, the complementary fasteners may be any of a variety of snap-fit connectors such as cantilever, torsional, and/or annular snap-fit connectors. As used herein, the term "snap-fit connector" is generally defined as a joint or connector having an interlocking component or protruding part (e.g., a hook, a stud, a bead, etc.) that deflects under the application of the joining force and catches in a depression in a mating joint or connector. For example, the complementary fastener 116 of the exterior face 104 may have a protruding part 117 (FIG. 2) that deflects under the application of a joining force (denoted by arrow F in FIG. 2) and catches in a depression 119 in the complementary fastener 122 of the exterior frame cover 120.

In some embodiments, the complementary fastener 116 of the exterior face 104 may be, for example, a female connector that is configured to mate with a male connector of the complementary fastener 122 of the exterior frame cover 120. Though joining of the exterior face 104 and exterior frame cover 120 are described above, the interior face 102 and the interior frame cover 124 may operate in a similar manner. It should also be understood that a variety of other types of fasteners and joining mechanisms may be employed to attach the frame covers to their respective faces and frame members as desired.

In some embodiments, the first frame member 108 includes a first reinforcement member 128. The first reinforcement member 128 is located within the first frame member 108 and between the interior face 102 and the exterior face 104, as shown in FIG. 1. In some embodiments, the first reinforcement member 128 comprises any of a variety of structural materials such as stainless steel, galvanized steel, aluminum, composite materials, and other suitable metals and/or materials. For example, the first reinforcement member 128 can include a stainless-steel sheet, ribbon, or wire. In some embodiments, the first reinforcement member 128 is comprised of a material having a modulus of elasticity (i.e., Young's Modulus) greater than 175 GPa. For example, the modulus of elasticity may be from about 175 GPa to 210 GPa. As used herein, the term "modulus of elasticity", also known as Young's Modulus, coefficient of elasticity, elasticity modulus, or elastic modulus, refers to a tensile elasticity of the material. In other terms, modulus of elasticity is a tendency of an object to deform along a given axis when opposing forces are applied along that axis. For example, the modulus of elasticity is defined as a ratio of the tensile stress to the tensile strain of a given material.

In some embodiments, the first reinforcement member 128 is located within the first frame member 108. The first reinforcement member 128 can be arranged in any configuration within the first frame member 108 as desired. For example, the first reinforcement member 128 may be located near the interior face 102, near the exterior face 104, or in the center of the first frame member 108 along the first longitudinal axis $X_1$.

In some embodiments, the first frame member 128 may include additional reinforcement members as desired. For example, the first frame member 108 can include a first reinforcement member 128, a second reinforcement member 130, a third reinforcement member 132, and a fourth reinforcement member 134. In some examples, the number of reinforcement members desired in the first frame member 108 may depend on a variety of factors including, for example, the desired strength and stiffness of the first frame member 108 or the configuration of the overall window assembly.

As discussed above, the reinforcement members may be located or arranged anywhere within the first frame member 108 as desired. For example, the first reinforcement member 128 and the second reinforcement member 130 may be located near the interior face 102 of the first frame member 108, and the third reinforcement member 132 and the fourth reinforcement member 134 may be located near the exterior face 104 of the first frame member 108, as shown in FIG. 1.

Figure 3A:
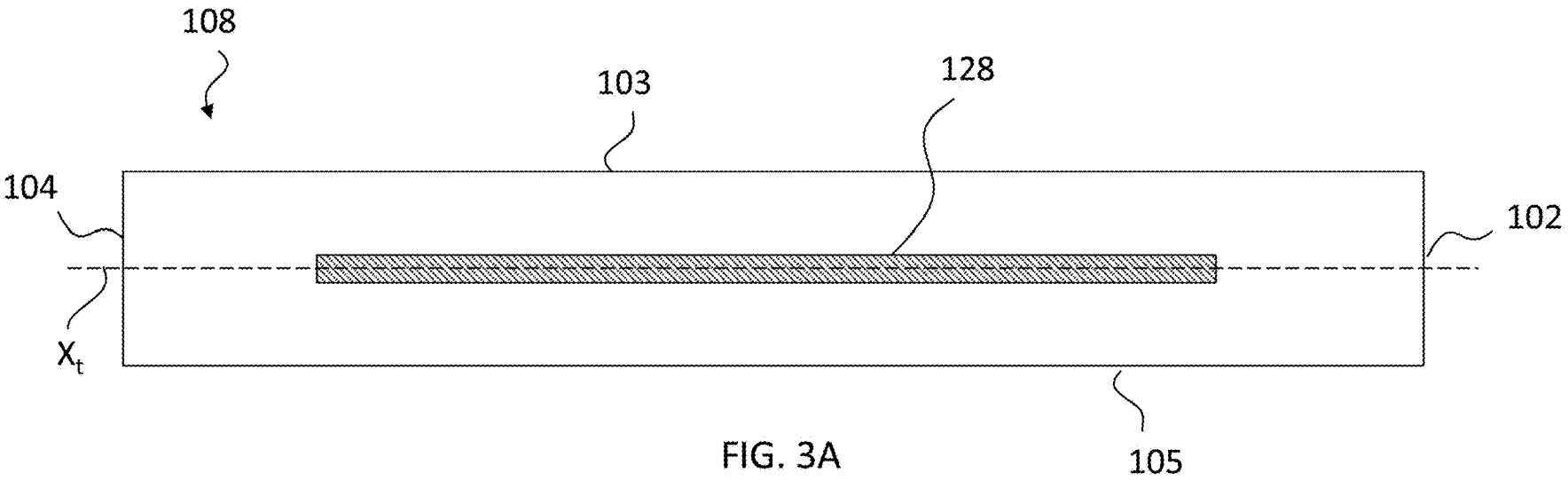
FIGS. 3A-C are cross-sectional views of various examples of a base frame, in accordance with some embodiments.
Figure 4A:
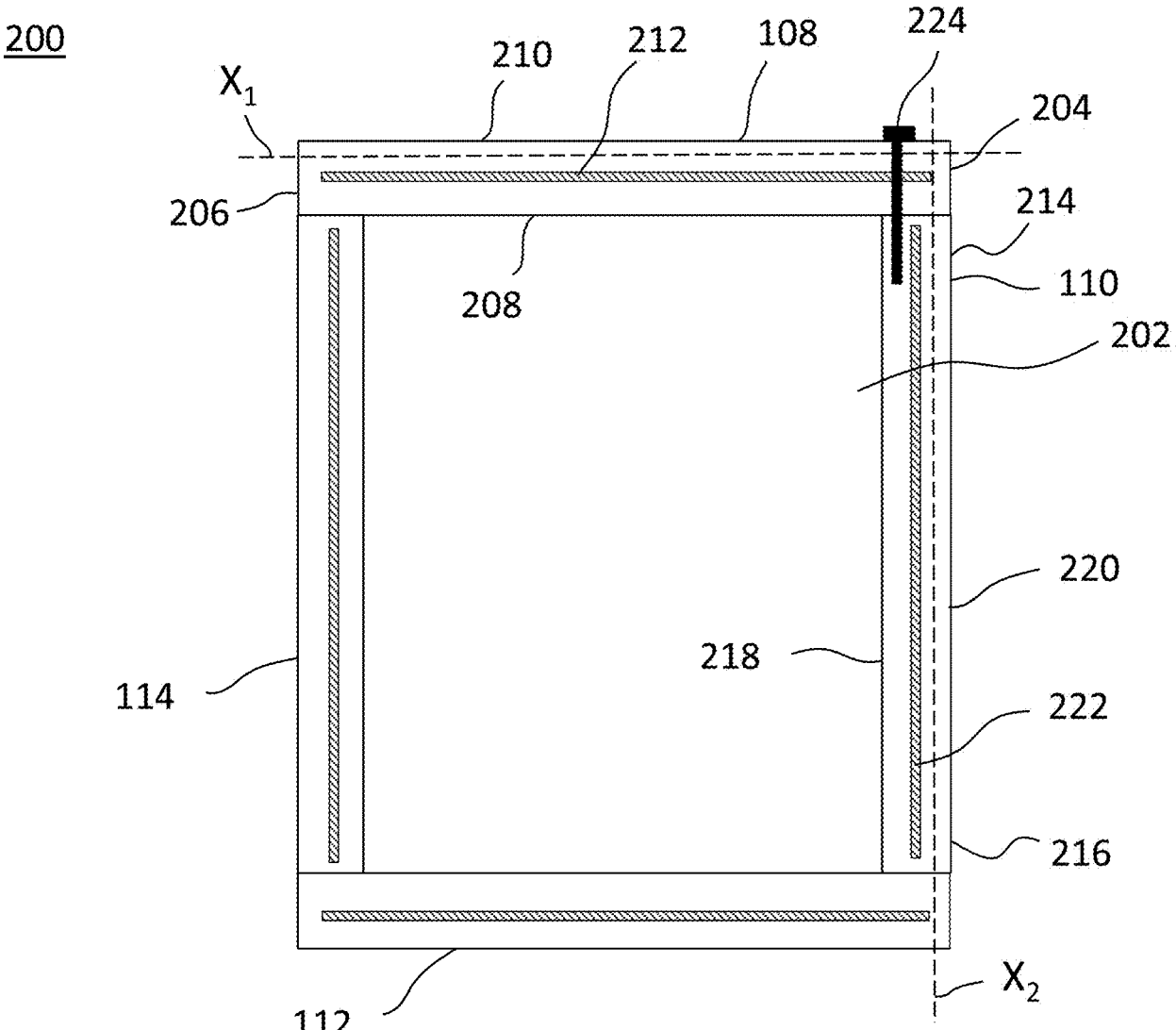
FIGS. 4A-4B are front views of a modular window frame, in accordance with an embodiment.

In some embodiments, the first frame member 108 may include a single reinforcement member (e.g., the first reinforcement member 128), as shown in FIG. 3A. In certain examples, the first reinforcement member 128 can be positioned at the center of the first frame member 108. For example, the first reinforcement member 128 may be equidistant from the interior face 102 and the exterior face 104 and/or a top face 103 and a bottom face 105, as shown. In some embodiments, the first reinforcement member 128 is also oriented along a first longitudinal axis $X_1$ of the first frame member 108 (FIG. 4A).

Figure 3B:
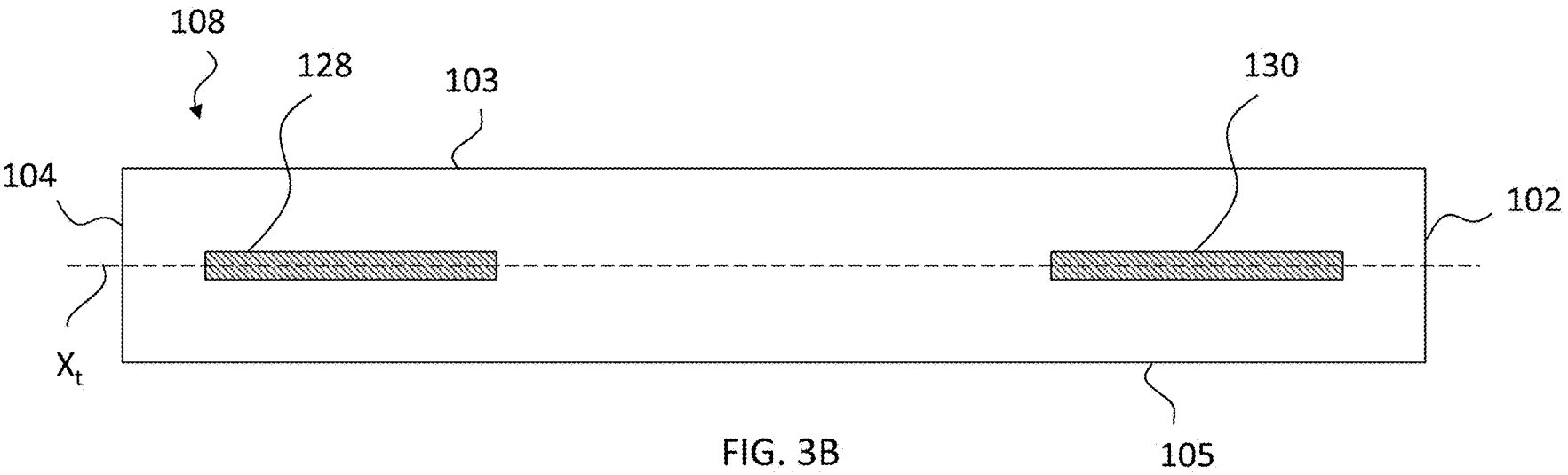

In other embodiments, the first frame member 108 may include a first reinforcement member 128 and a second reinforcement member 130. As shown in FIG. 3B, the first and second reinforcement members 128, 130 may be positioned within the same plane (e.g., spaced along a first transverse axis $X_t$). In other embodiments, the first and second reinforcement members 128, 130 can be positioned at any location within the first frame member 108 as desired. As discussed above, the first and second reinforcement members 128, 130 are also oriented along a first longitudinal axis $X_1$ (FIG. 4A), which is perpendicular to the first transverse axis $X_t$.

Figure 3C:
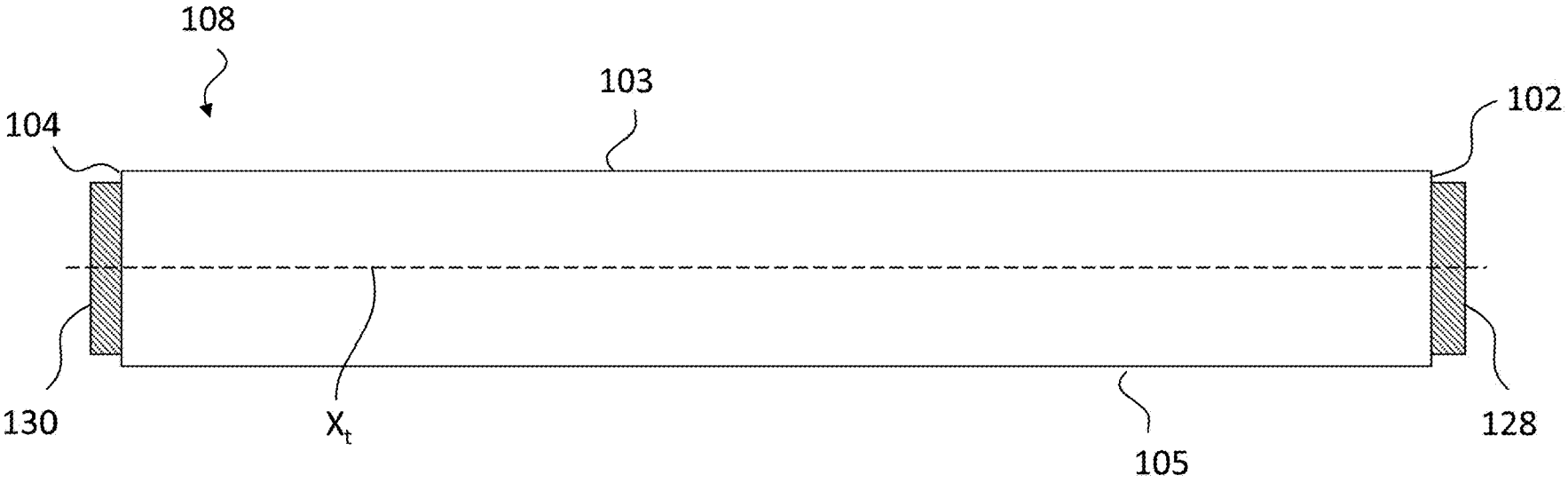

In yet other embodiments, one or more of the reinforcement members (e.g., the first reinforcement member 128 and the second reinforcement member 130) may be located on the outside of the first frame member 108, as shown in FIG. 3C. In some embodiments, the reinforcement members may be located at the interior face 102 and the exterior face 104 of the first frame member 108. However, the reinforcement members can be located elsewhere such as, for example, at the top face 103 and/or the bottom face 105.

Though the examples discussed herein show a variety of arrangements of reinforcement members within and/or around the first frame member 108, it should be understood that any other arrangement of reinforcement members can be employed as desired. As discussed above, the desired arrangement may depend on a variety of factors including the desired strength of the first frame member 108, processing limitations, and/or the configuration of the overall window assembly, among other things.

In some embodiments, the base frame 100, also referred to herein as a modular window frame, is formed by securing the plurality of frame members 106 (e.g., the first frame member 108, the second frame member 110, the third frame member 112, and the fourth frame member 114) together. For example, each of the plurality of frame members 106 may be secured together at their respective ends to form a perimeter, as shown in FIG. 4A.

FIG. 4A is a front view of the modular window frame, in accordance with an embodiment. In some embodiments, the modular window frame 200 includes a plurality of frame members that define an interior region 202 supporting a glass unit (not shown). The modular window frame 200 includes a first frame member 108, a second frame member 110, a third frame member 112, and a fourth frame member 114, referred to collectively herein as "frame members." As shown, each of the frame members is secured to one another at their respective ends as subsequently described.

In some embodiments, the first frame member 108 has a first end 204, a second end 206, an inner face 208, an outer face 210, a longitudinal axis $X_1$, and a first reinforcement member 212 oriented along the longitudinal axis $X_1$. The second frame member 110 also has a first end 214, a second end 216, an inner face 218, an outer face 220, a longitudinal axis $X_2$ and a second reinforcement member 222 oriented along the longitudinal axis $X_2$. The first frame member 108 and the second frame member 110 are oriented such that they are perpendicular to one another (e.g., the first and second frame members 108, 110 form a 90° angle with one another). For example, the longitudinal axis $X_1$ of the first frame member 108 is perpendicular to the longitudinal axis $X_2$ of the second frame member 110. The first end 204 of the first frame member 108 is abutted to the inner face 218 of the second frame member 110 at the first end 214 of the second frame member 110 to form a non-chamfered corner. A chamfer can be defined as a transitional edge or sloping surface between two, adjacent faces that allows the faces to adjoin at about a 45° angle. Therefore, as used herein, the term "non-chamfered" can be defined as a corner that is not chamfered, or a corner that does not have a transitional edge or sloping surface between adjacent faces (e.g., the adjacent faces meet at a 90° angle).

The modular window frame 200 also includes a first fastener 224. In some embodiments, the first fastener 224 extends into the outer face 220 of the second frame member 110, through the second reinforcement member 222, out from the inner face 218 of the second frame member 110, and into the first end 204 of the first frame member 108 to secure the first frame member 108 to the second frame member 110, as shown. In various embodiments, the first fastener 224 can be any of a nail, a screw, a pin, a bolt, a rod, a stake, or any other fastener capable of securing the first frame member 108 to the second frame member 110.

Figure 4B:
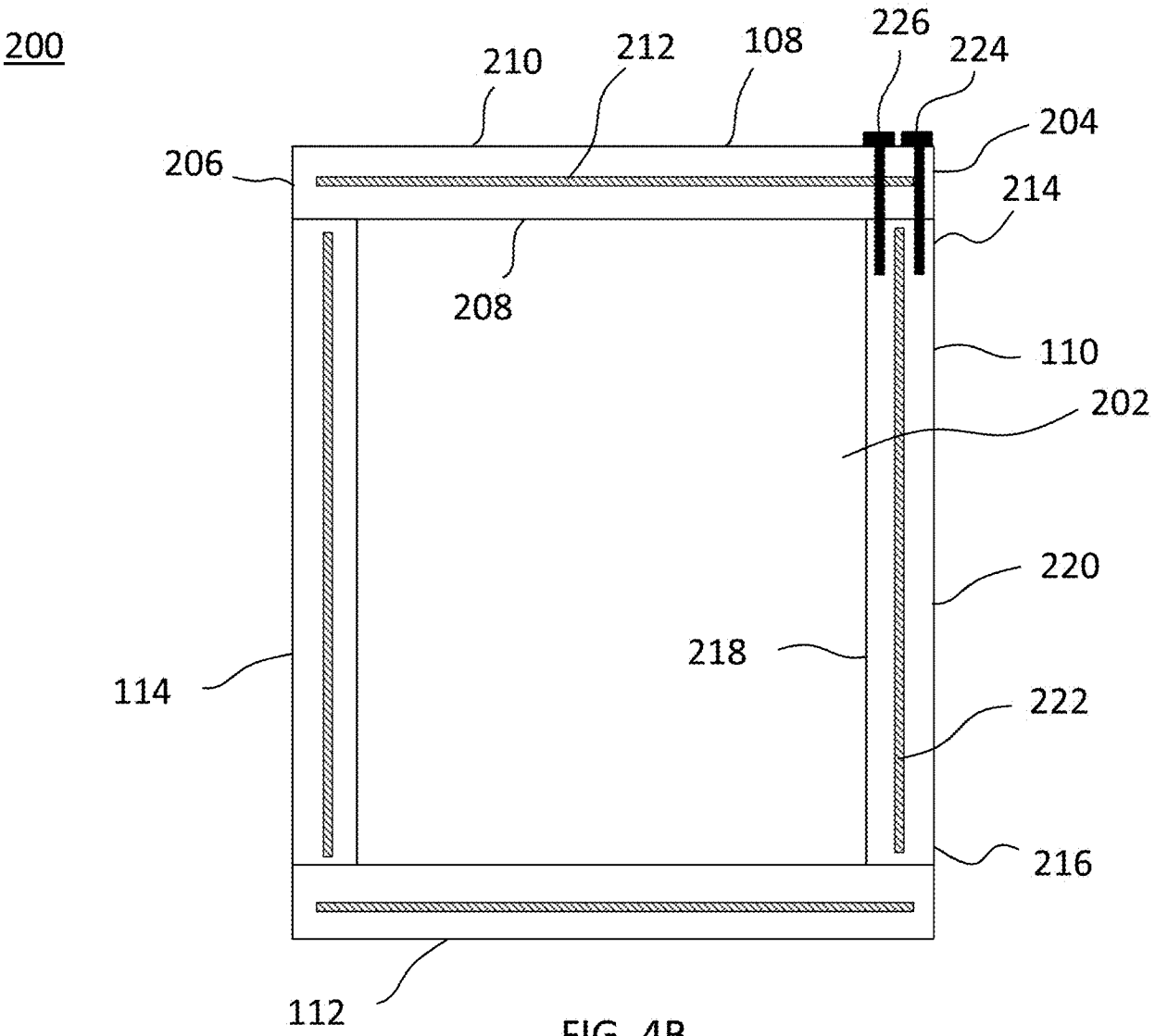

In some embodiments, only one fastener is used (FIG. 4A). In other embodiments, multiple fasteners can be used, as shown in FIG. 4B. FIG. 4B shows a first fastener 224 and a second fastener 226 each extending into the outer face 220 of the second frame member 110, through the second reinforcement member 222, out from the inner face 218 of the second frame member 110, and into the first end 204 of the first frame member 108 to secure the first frame member 108 to the second frame member 110. In some embodiments, the first fastener 224 extends into the first end 204 near the inner face 208 of the first frame member 108, while the second fastener 226 extends into the first end 204 near the outer face 210 of the first frame member 108. For example, the first and second fasteners 224, 226 may extend into the first end 204 of the first frame member 108 on either side of the first reinforcement member 212. However, it should be known that any number of fasteners (e.g., one fastener, two fasteners, or more than two fasteners) can be used at any desired locations for securing the first frame member 108 to the second frame member 110.

Figure 5:
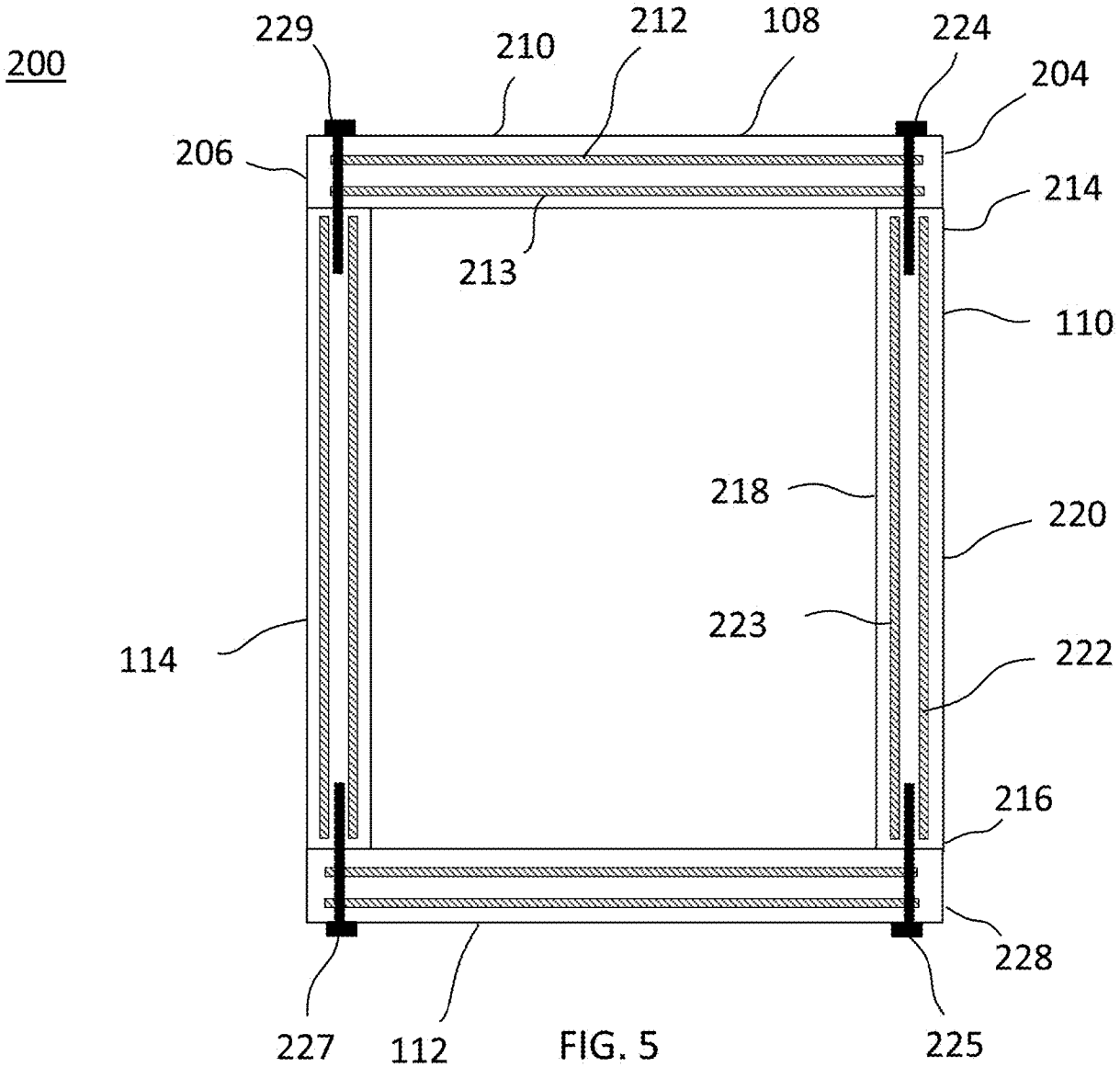
FIG. 5 is a front view of another example of a modular window frame, in accordance with an embodiment.

Though not shown in FIGS. 4A and 4B, each of the frame members can be secured to one another to form a non-chamfered corner in a similar manner as discussed above. For example, the third frame member 112 can be oriented such that it is perpendicular to the second frame member 110. A first end 228 of the third frame member 112 can then be abutted to the inner face 210 of the second frame member 110 at the second end 216 of the second frame member 110 to form a non-chamfered corner (FIG. 5). A second fastener 225 can then secure the second frame member 110 to the third frame member, as discussed above.

In some embodiments, each of the frame members may include more than one reinforcement member. FIG. 5 is a front-view of a modular window frame, in accordance with another embodiment. As shown, the first frame member 108 includes a first reinforcement member 212 and a second reinforcement member 213. The first and second reinforcement members 212, 213 are oriented along the first longitudinal axis $X_1$ such that they are parallel to one another. The second frame member 110 also includes a first reinforcement member 222 and a second reinforcement member 223 oriented along the second longitudinal axis $X_2$ such that the reinforcement members 212, 213 of the first frame member 108 are perpendicular to the reinforcement members 222, 223 of the second frame member 110.

As discussed above, the first end 204 of the first frame member 108 is abutted to the inner face 218 of the second frame member 110 at the first end 214 of the second frame member 110 to form a non-chamfered corner. In some embodiments, a single fastener (e.g., first fastener 224) extends into the outer face 220 of the second frame member 110, through the second reinforcement member 222, out from the inner face 218 of the second frame member 110, and into the first end 204 of the first frame member 108 between the first reinforcement member 212 and the second reinforcement member 213. As shown in FIG. 5, each of the frame members can be secured to one another in a similar manner to form a non-chamfered corner. For example, the third frame member 112 is secured to the second frame member 110 by a second fastener 225, the fourth frame member 114 is secured to the third frame member 112 by a third fastener 227, and the fourth frame member 114 is secured to the first frame member 108 by a fourth fastener 229. However, it should be understood that the frame members can be secured to one another by using any number and orientation of fasteners as desired.

Figure 6:
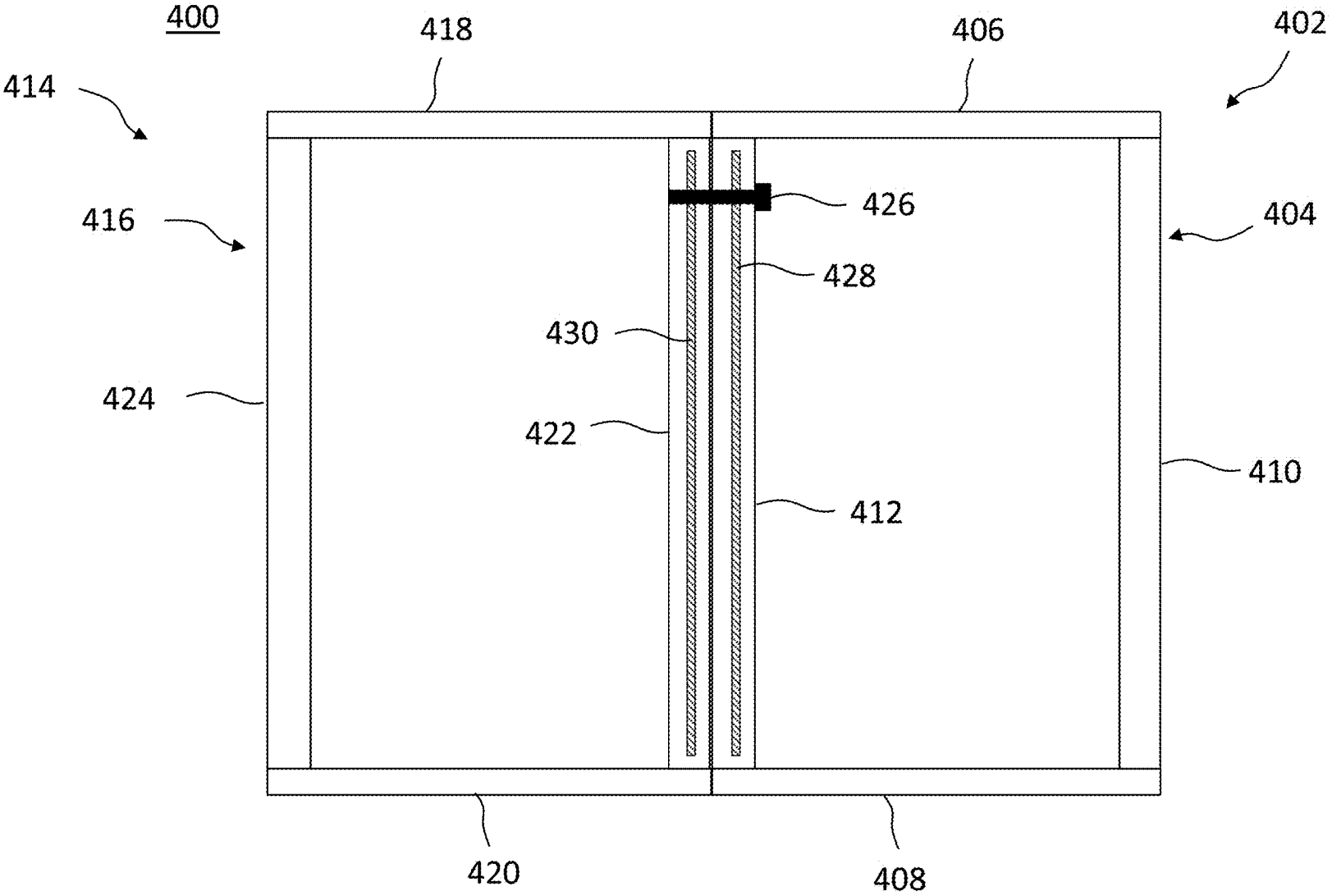
FIG. 6 is a front view of a mulled window assembly, in accordance with an embodiment.

FIG. 6 is a front view of a mulled window assembly, in accordance with an embodiment. In some embodiments, multiple modular window frames, otherwise referred to herein as "window units," can be mulled together to form a mulled window assembly 400. As used herein, the term "mulled" is defined as attached or adjoined (e.g., multiple window units can be attached or adjoined to one another). In some embodiments, the mulled window assembly 400 includes a first window unit 402 (e.g., a first modular window frame). The first window unit 402 includes a first plurality of frame members 404 comprising an upper frame member 406, a lower frame member 408, a first side frame member 410, and a second side frame member 412. One or more of the first plurality of frame members 404 can include a reinforcement member 428, though any number of reinforcement members may be used as desired.

The mulled window assembly 400 also includes a second window unit 414 (e.g., a second modular window frame). The second window unit 414 includes a second plurality of frame members 416 comprising an upper frame member 418, a lower frame member 420, a first side frame member 422, and a second side frame member 424. Similar to the first window unit 402, one or more of the second plurality of frame members 416 can include a reinforcement member 430, though any number of reinforcement members may be used as desired.

Each of the first window unit 402 and second window unit 414 can be assembled similar to that discussed above for the modular window frame 200. For example, the upper frame member 406 and the first side frame member 410 are oriented perpendicular to one another and secured at their respective ends with a first fastener 224 (FIG. 4A) to form a non-chamfered corner. The lower frame member 408 and the second side frame member 412 can be oriented and secured in a similar manner, such that the upper frame member 406 and the lower frame member 408 are parallel to one another and perpendicular to both the first side frame member 410 and the second side frame member 412.

The mulled window assembly 400 also includes a first mulling fastener 426 to secure the first window unit 402 and second window unit 414 together. In some embodiments, the first mulling fastener 426 extends through the second side frame member 412 of the first window unit 402, through the reinforcement member 428 of the second side frame member 412, through the first side frame member 422 of the second window unit 414, and through the reinforcement member 430 of the first side frame member 422 such that the first window unit 402 and the second window unit 414 are adjacent to one another. Though shown at a location near the upper frame members 406 and 418, the first mulling fastener 426 can be located at any location along the length of the second side frame member 412 and first side frame member 422. For example, the first mulling fastener 426 can be located near the upper frame members 406 and 418, near the lower frame members 408 and 420, in the center of the second side frame member 412 and/or the first side frame member 422, or at any other location as desired.

Figure 7:
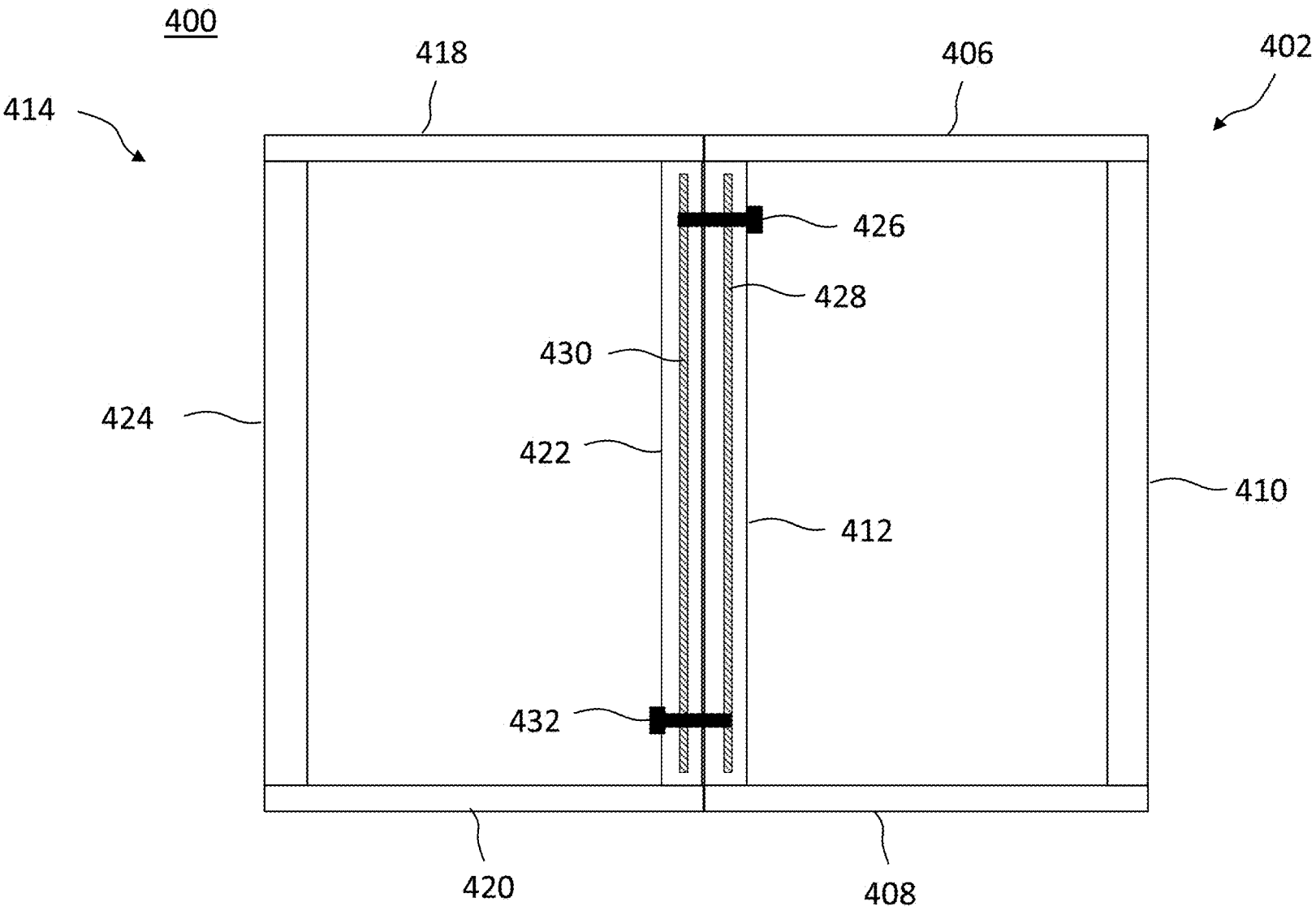
FIG. 7 is a front view of a mulled window assembly, in accordance with an embodiment.

In some embodiments, the mulled window assembly 400 includes a second mulling fastener 432, as shown in FIG. 7. The second mulling fastener 432 may be spaced from the first mulling fastener 426 any distance along the length of the second side frame member 412 and first side frame member 422 as desired. In one example, the first mulling fastener 426 is located near the upper frame members 406, 418 and the second mulling fastener 432 is located near the lower frame members 408, 420. Though shown with only two mulling fasteners, it should be understood that the mulled window assembly 400 can include any number of mulling fasteners as desired to mull the first window unit 402 and the second window unit 414 together.

In various embodiments, the first mulling fastener 426 can be any of a nail, a screw, a pin, a bolt, a rod, a stake, or any other fastener capable of securing the first window unit 402 to the second window unit 414, similar to that described above for the first fastener 224 (FIG. 4A).

Figure 8:
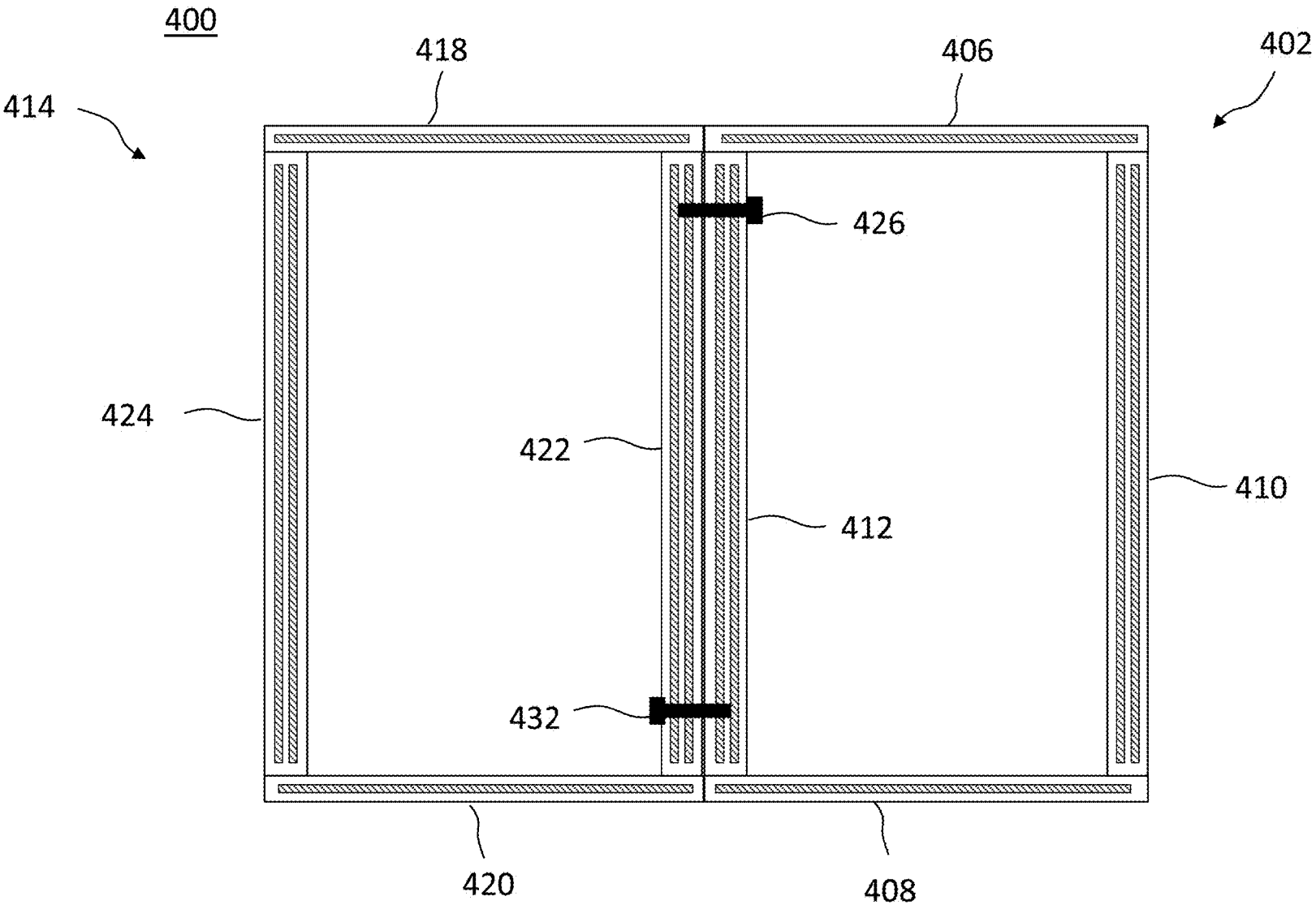
FIG. 8 is a front view of a mulled window assembly, in accordance with an embodiment.

In various embodiments, the first window unit 402 and second window unit 414 may include any number of reinforcement members and mulling fasteners as desired. For example, FIG. 8 shows a mulled window assembly 400 having a non-uniform distribution of reinforcement members. As shown, the first and second side frame members 410, 412 of the first window unit 402 each include two reinforcement members, while the upper frame member 406 and lower frame member 408 each include one reinforcement member. In some embodiments, the second window unit 414 may have the same distribution and/or orientation of reinforcement members as the first window unit 402, as shown. However, in other embodiments, the first and second window units 402, 414 can have differing distributions and/or orientations of reinforcement members as desired.

Though the second side frame member 412 of the first window unit 402 has been described as being mulled to the first side frame member 422 of the second window unit 414, it should be understood that any frame member of the first window unit 402 can be mulled to any frame member of the second window unit 414 as desired, depending on the desired orientation or configuration of the mulled window assembly 400.

Figure 9:
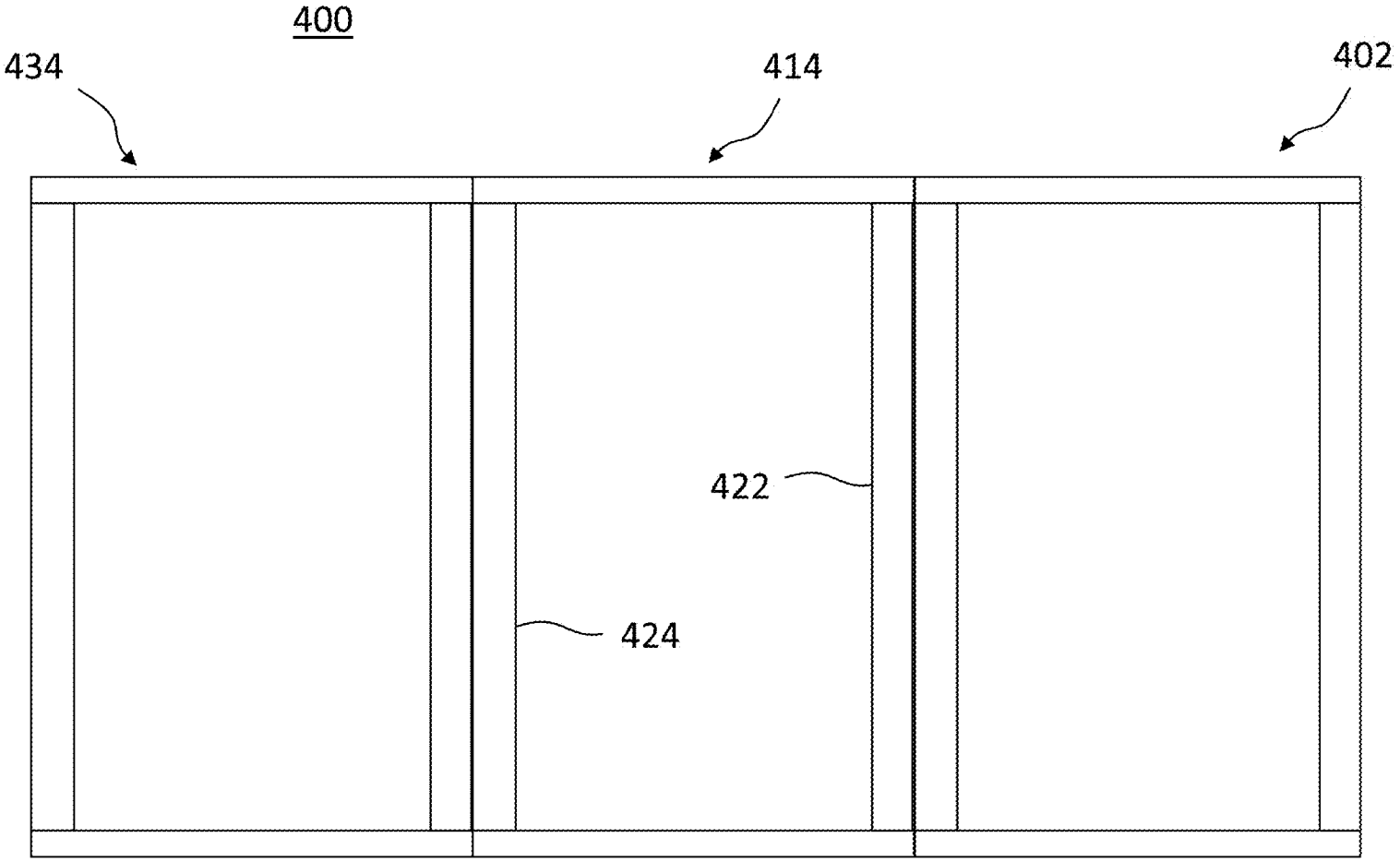
FIG. 9 is a front view of a mulled window assembly having three window units, in accordance with an embodiment.

In some embodiments, the mulled window assembly 400 can include additional window units. For example, the mulled window assembly 400 may include a third window unit 434 as shown in FIG. 9. In such an arrangement, the second window unit 414 is mulled to both the first window unit 402 and the third window unit 434 on either side. For example, the second side frame member 424 of the second window unit 414 is mulled to the first window unit 402, and the first side frame member 422 of the second window unit 414 is mulled to the third window unit 434. As discussed above, any number and orientation of mulling fasteners can be used to mull each of the first, second, and third window units 402, 414, 434 together.

Persons skilled in the art will readily appreciate that various aspects of the present disclosure can be realized by any number of methods and apparatus configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting.

The invention of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. A modular window frame including a plurality of frame members defining an interior region supporting a glass unit, the modular window frame comprising:

a first frame member including a pultruded fiberglass body and having a first end, a second end, an inner face, an outer face, a longitudinal axis and a first reinforcement member oriented along the longitudinal axis, the first reinforcement member being formed of a metallic material having a ribbon shape, the first reinforcement member extending within the fiberglass body of the first frame member; and a second frame member including a pultruded fiberglass body and having a first end, a second end, an inner face, an outer face, a longitudinal axis and a second reinforcement member oriented along the longitudinal axis, the second reinforcement member being formed of a metallic material having a ribbon shape, the second reinforcement member extending within the fiberglass body of the second frame member, the first frame member and the second frame member oriented perpendicular to one another with the first end of the first frame member abutted to the inner face of the second frame member to form a non-chamfered corner; and a first fastener extending into the outer face of the second frame member, through the second reinforcement member, out from the inner face of the second frame member, and into the first end of the first frame member to secure the first frame member to the second frame member.

2. The modular window unit of claim 1, wherein the first reinforcement member and the second reinforcement member comprise stainless steel.

3. The modular window unit of claim 1, wherein the non-chamfered corner is a 90° corner.

4. The modular window unit of claim 1, further comprising a third frame member having a first end, a second end, an inner face, an outer face, a longitudinal axis and a third reinforcement member oriented along the longitudinal axis.

5. The modular window unit of claim 4, further comprising a fourth frame member a first end, a second end, an inner face, an outer face, a longitudinal axis and a fourth reinforcement member oriented along the longitudinal axis.

6. The modular window unit of claim 5, wherein the third frame member is adjoined to the second frame member by a second fastener, and wherein the fourth frame member is adjoined to the third frame member by a third fastener.

7. The modular window unit of claim 1, wherein the first fastener is any one of a nail, a screw, a pin, a bolt, a rod, a stake.

8. A method for assembling a modular window frame, the method comprising:

orienting a first frame member including a polymeric body and having a first end, a second end, an inner face, an outer face, a longitudinal axis and a first reinforcement member formed of a metallic material having a ribbon shape and oriented along the longitudinal axis within the polymeric body with a second frame member including a polymeric body and having a first end, a second end, an inner face, an outer face, a longitudinal axis and a second reinforcement member formed of a metallic material having a ribbon shape and oriented along the longitudinal axis within the polymeric body, such that the first frame member and second frame member are perpendicular to one another, the first end of the first frame member abutted to the inner face of the second frame member to form a non-chamfered corner; and securing the first frame member to the second frame member by inserting a first fastener into the outer face of the second frame member, through the second reinforcement member, out from the inner face of the second frame member, and into the first end of the first frame member.

* * * * *